US006050168A

United States Patent [19]

Kuchta et al.

[11] Patent Number: 6,050,168

[45] Date of Patent: Apr. 18, 2000

[54] CUTTER TABLE FOR PERFORMING WORK OPERATIONS ON ONE OR MORE LAYERS OF SHEET-TYPE WORK MATERIAL

[75] Inventors: Richard Kuchta, Shickshinny, Pa.; Kevin A. Pearl, Manchester, Conn.; Barbara St. John, Vernon, Conn.; Timothy VanderVos, Vernon, Conn.; Joseph Vivirito, South Windsor, Conn.

[73] Assignee: Gerber Technology, Inc., Tolland, Conn.

[21] Appl. No.: 09/150,142

[22] Filed: Sep. 9, 1998

[51] Int. Cl.[7] ..... B26D 5/00

[52] U.S. Cl. ..... 83/522.12; 83/522.11; 83/76.7; 83/940

[58] Field of Search ..... 83/DIG. 940, DIG. 941, 83/DIG. 939, DIG. 76.9, DIG. 522.12, DIG. 522.26, DIG. 522.29, DIG. 522.24, DIG. 522.19, DIG. 522.18, DIG. 522.16, DIG. 522.14, DIG. 522.15, DIG. 522.11

[56] References Cited

U.S. PATENT DOCUMENTS

| | | | |
|---|---|---|---|
| 3,541,243 | 12/1966 | Whitsel | 83/76.4 X |
| 3,848,490 | 11/1974 | Arel | 83/756 X |
| 4,133,235 | 1/1979 | Gerber | 83/756 X |
| 4,178,820 | 12/1979 | Gerber | 83/756 X |
| 4,494,433 | 1/1985 | Gerber | 83/100 X |
| 4,583,181 | 4/1986 | Gerber et al. | 83/76.8 X |
| 4,793,033 | 12/1988 | Schneider et al. | 83/100 X |
| 4,920,495 | 4/1990 | Pilkington | 83/940 X |
| 5,333,111 | 7/1994 | Chaiken et al. | 83/936 X |

FOREIGN PATENT DOCUMENTS

| | | | |
|---|---|---|---|
| 2057956 | 4/1981 | United Kingdom | 83/940 |

*Primary Examiner*—Rinaldi I. Rada
*Assistant Examiner*—Dominic J. Troiano
*Attorney, Agent, or Firm*—McCormick, Paulding & Huber LLP

[57] ABSTRACT

In a cutter table for performing work operations on one or more layers of sheet-type work material a work material support surface is mounted to a frame having an elongated support mounted for movement thereon. A cutter head for carrying a reciprocating cutting blade is mounted to the support and movable relative thereto in response to commands issued from a programmable controller. Indicators in the form of an array of colored lights are also provided and illuminate in response to commands issued from the controller to alert an operator as to current machine conditions.

14 Claims, 2 Drawing Sheets

CUTTER TABLE FOR PERFORMING WORK OPERATIONS ON ONE OR MORE LAYERS OF SHEET-TYPE WORK MATERIAL

FIELD OF THE INVENTION

The present invention is generally directed to devices for performing work operations on one or more layers of sheet-type work material stacked one-on-top-of-the-other, and is more specifically directed to a sheet-type work material cutter table that includes an apparatus for alerting an operator as to the current operating condition of the machine.

BACKGROUND OF THE INVENTION

In the production of garments, pattern pieces are usually cut in a single operation from several layers of fabric stacked one-on-top-of-the-other and referred to by those skilled in the pertinent art as a "lay". Generally, the layers of fabric that comprise the lay are positioned on a table by an apparatus referred to as a spreader. The spreader supports a roll of fabric or other work material and is mounted for movement back-and-forth along the table's length. As the spreader moves, fabric from the roll is selectively advanced onto the spreading table, one layer at a time. Once a predetermined length of fabric has been positioned onto the spreading table, it is cut from the roll, and the process is repeated, positioning additional layers of fabric on top of the underlying layers previously spread until the lay is complete.

After the lay has been spread, it is usually transferred from the spreading table to the work material support surface of a cutter table. The cutter table typically includes a reciprocating blade that traverses the support surface cutting the pattern pieces from the lay in response to commands issued from a controller.

In the mass production of garments, a facility may have several production lines operating simultaneously. Often each of these production lines are over 100 yards long with several spreading tables being serviced by a single cutter table mounted on tracks for movement between the spreading tables. A problem associated with production lines of this size is that it is difficult for an operator to ascertain the operating conditions of the cutter tables, for example, a malfunctioning cutter head, or misfed fabric, or even a machine that is ready for operation may not be detected until damage has occurred either to the cutter table, or the fabric being cut, or until a period of time has elapsed resulting in lost production.

Based on the foregoing, it is the general object of the present invention to provide an apparatus for alerting an operator as to the current operating conditions of a machine that overcomes the difficulties and drawbacks of prior art devices.

It is a more specific object of the present invention to provide an apparatus for alerting an operator as to the current operating conditions of a cutter table that is readily visible by an operator even when positioned remotely from the cutter table.

SUMMARY OF THE INVENTION

The present invention is directed to a cutter table for performing work operations on one or more layers of sheet-type work material. The cutter table includes a frame, having a work material support surface coupled thereto, as well as a programmable controller for storing work material cutting data therein is in machine readable format. An elongated support is coupled to the frame for movement in a direction longitudinal thereof, and a cutting head adapted to carry a reciprocating blade is coupled to the support. The cutting head is movable in a direction longitudinal of the support, and transversely of the frame, in response to commands issued from the programmable controller. Accordingly, the combined movement of the support and the cutter head facilitates the cutting of shaped pattern pieces from the work material.

Indicating means are also provided for alerting an operator as to the status of the cutter table during the performance of a cutting operation. Preferably an upright support is coupled to the frame, and the indicating means includes at least one light mounted on the upstanding support. During operation, the light will illuminate and/or blink to denote, the status, different operating conditions, or problems encountered by the cutter table during the performance of a cutting operation. In order to appropriately energize the light, means are provided for generating a signal commanding the light to operate continuously, or intermittently, thereby producing a particular blinking pattern. The means for generating these signals can either come directly from a sensor for detecting various machine operating parameters, or the signal can be generated by the programmable controller in response to various different inputs.

In the preferred embodiment of the present invention, the upstanding support includes first and second upright members, each coupled to the frame opposite each other. A cross beam, spaced above the work material support surface of the cutter table, extends between and is coupled to each of the supports. A plurality of lights, each of a different color, are mounted on the cross beam, with each being selectively energizable in response to commands issued from the programmable controller. Preferably, at least one of the upright members, and the cross beam define a hollow interior area, such that all of the wiring between the lights and the means for providing power to energize the lights can be passed through the hollow interior areas.

DETAILED DESCRIPTION OF THE PREFERRED EMBODIMENT

Figure 1:
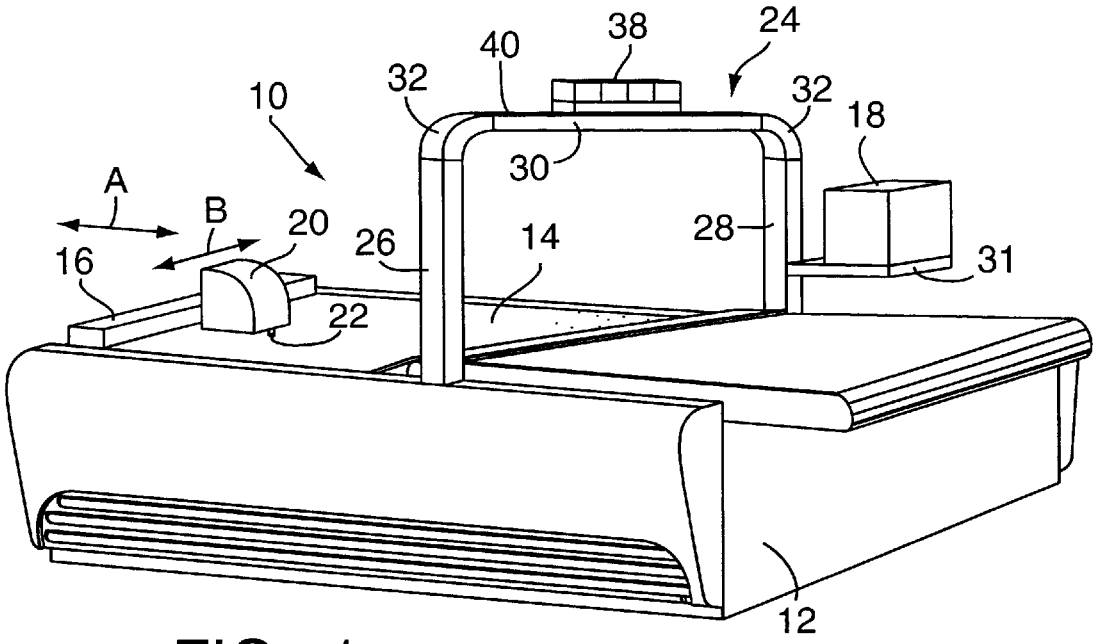
FIG. 1 is a perspective view of a cutter table of the present invention showing the upstanding support having a plurality of lights mounted thereon.

As shown in FIG. 1, a cutter table for performing work operations on one or more layers of sheet-type work material is generally designated by the reference number 10 and includes a frame 12, having a work material support surface 14 coupled thereto. An elongated support 16 is mounted to the frame 12 for movement back and forth longitudinally thereof, as indicated by the arrows labeled "A", in response to commands issued from a programmable controller 18. A cutter head 20 is mounted to the support 16 for movement in a direction longitudinal of the support, and transversely of the frame, as indicated by the arrows labeled "B". A blade 22 is carried by the cutter head 20 and selectively reciprocable in response to commands issued from the programmable controller 18. During operation, layers of sheet-type work material stacked one-on-top-of-the-other are positioned on the work material support surface 14 and the cutter head 20 traverses the work material selectively cutting pattern pieces therefrom in response to commands issued from the programmable controller 18.

An upstanding support 24, is also provided and includes a first upright member 26 attached to the frame 12, and a second upright member 28, spaced apart from, and also attached to the frame opposite to the first upright member. A cross beam 30 is positioned above the work support surface 14 between the first and second upright members, 26 and 28 respectively. The cross beam 30 is coupled to the first and second upright members, 26 and 28 respectively via elbows 32. Each elbow 32 defines a pair of outwardly projecting extensions 34 adapted to be received in hollow interior areas 36 defined by the upright members, 26 and 28 respectively, and the cross beam 30.

Preferably, the upright members, 26 and 28, the cross beam 30, and the elbows 32 are rectangular in cross section, however, the present invention is not limited in this regard as other cross-sectional shapes, such as a circular cross section, can be substituted without departing from the broader aspects of the present invention. In addition, a bracket 31 adapted to support the controller 18 is attached to one of the upright members, 26 or 28 respectively, and can be used to support a controller in the form of a personal computer.

Figure 2:
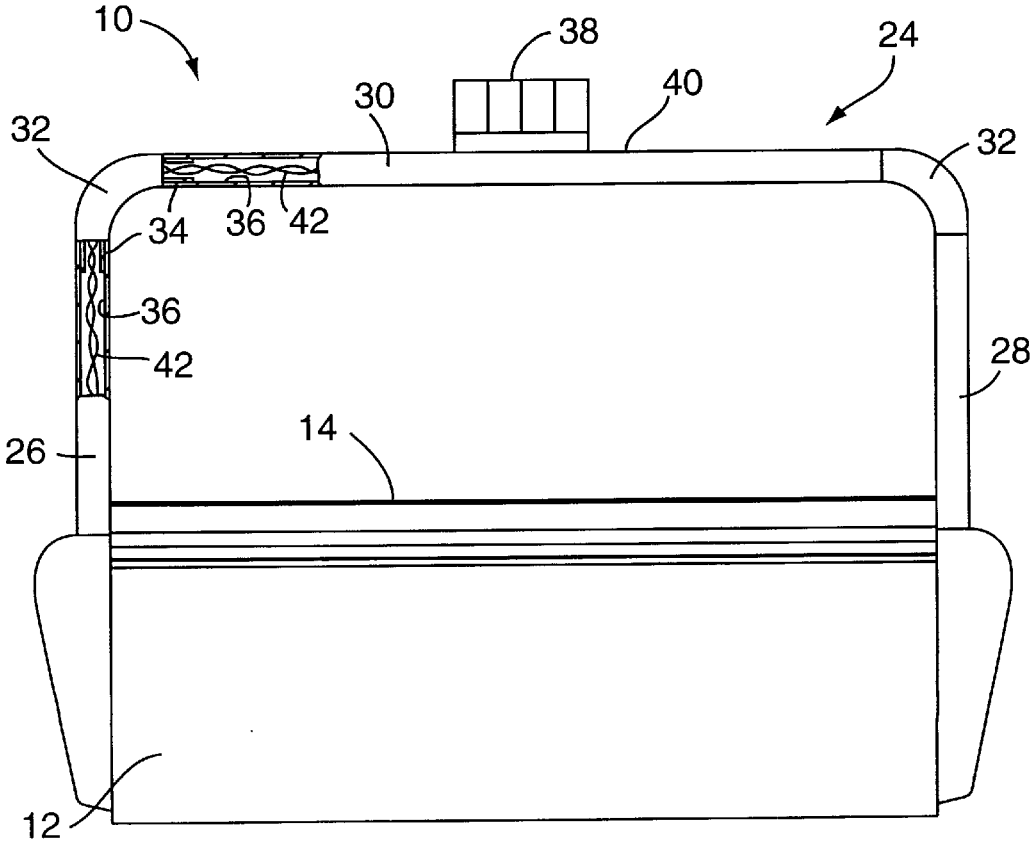
FIG. 2 is a front elevational view of the cutter table of FIG. 1, showing the cross beam and one of the upright members partially cut away.

As best seen in FIG. 2, a plurality of indicator lights 38 are approximately centrally mounted on an upper surface 40 of the cross member 30. Each indicator light 38 is preferably of a different color and can be made to illuminate, or blink intermittently, in response to commands issued from the controller 18. Alternatively, the lights 38 can be caused to illuminate in response to signals received directly from sensors (not shown) mounted to the frame for detecting various different machine parameters.

Still referring to FIG. 2, the electrical wiring 42 necessary to operate the lights 38 extends through the hollow interior areas 36 between the lights 38 and a power source (not shown) for energizing the lights. During a cutting operation, the lights 38 will illuminate or blink when various different machine operating conditions or anomalies are encountered. For example, constant illumination of one of the differently colored lights could indicate that the machine is ready for operation, is running, maintenance is required, or an error has been encountered.

Figure 3:
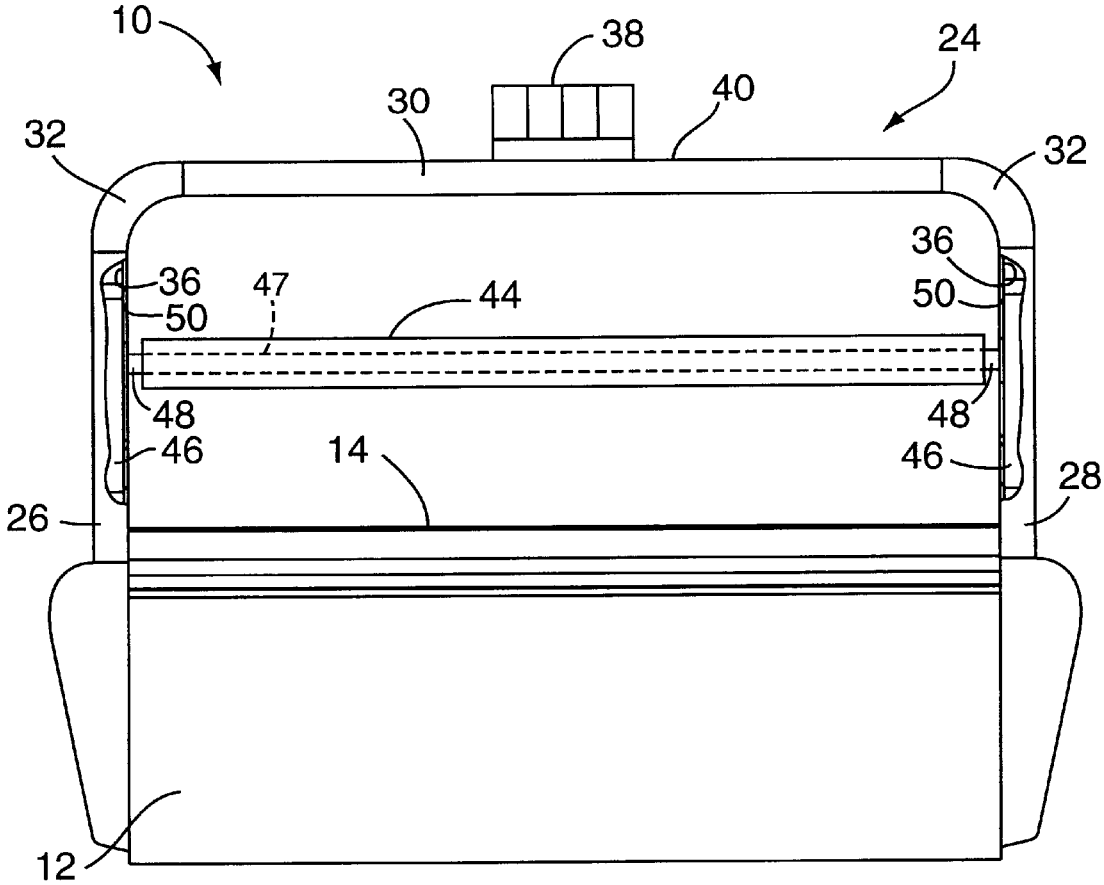
FIG. 3 is a front elevational view of the cutter table of FIG. 2 showing a roll of polymeric film rotatably coupled to actuators for movement between a raised and a lowered position.

As shown in FIG. 3, a roll of polymeric film 44 for sealing the layers of work material during a cutting operation can be rotatably coupled to a pair of pneumatic cylinders 46 by a bar having opposed ends 48 mounted in the interior area 36 of the first and second upright members, 26 and 28 respectively. A slot 50 is defined by each of the upright members 26 and 28, and opposed ends 48 of the bar 47 extend through the slots 50 to allow the roll to be moved between a raised and a lowered position in response to commands issued from the programmable controller 18. While pneumatic cylinders have been shown and described, the present invention is not limited in this regard as other actuators, such as hydraulic cylinders or lead screws can be substituted without departing from the broader aspects of the present invention.

While preferred embodiments have been shown and described, various modifications and substitutions may be made without departing from the spirit and scope of the invention. Accordingly, it is to be understood that the present invention has been described by way of example, and not by limitation.

What is claimed is:

1. A cutter table for performing work operations on one or more layers of sheet-type work material, comprising:

a frame;

a work material support surface coupled to said frame;

a programmable controller mounted to the cutting table for storing sheet-type work material cutting data, and for issuing commands to said cutter table;

an elongated support mounted on and extending transversely across said frame for movement in a direction longitudinal of said frame in response to commands issued from said programmable controller;

a cutting head coupled to said support for movement in a direction longitudinally thereof, and transversely across said frame in response to commands issued from said programmable controller;

a blade reciprocatingly mounted to said cutting head for performing cutting operations on one or more layers of sheet type work material carried by said support surface; and indicating means for alerting an operator as to the operational status of the cutter table, the indicating means including:

an upstanding support having a first upright member coupled to the frame, a second upright member coupled to the frame opposite to and spaced from the first upright member, and a cross beam interposed between and coupled to the first and second upright member, the cross beam being positioned above and extending transversely across the work material support surface;

at least one indicating light mounted on the upstanding support; and means for generating a signal to selectively energize the indicating light.

2. A cutter table for performing work operations on one or more layers of sheet-type work material, as defined by claim 1 further comprising a plurality of indicating lights mounted on said upstanding support.

3. A cutter table for performing work operations on one or more layers of sheet-type work material, as defined by claim 3, wherein each of said plurality of indicating lights is a different color.

4. A cutter table for performing work operations on one or more layers of sheet-type work material, as defined by claim 1, wherein said means for generating a signal includes at least one sensor coupled to the cutter table and in electronic communication with said frame for sensing one or more machine operating parameters.

5. A cutter table for performing work operations on one or more layers of sheet-type work material, as defined by claim 1, wherein said means for generating a signal is said programmable controller.

6. A cutter table for performing work operations on one or more layers of sheet-type work material, as defined by claim 1, wherein said indicating means includes at least one light mounted on said cross beam.

7. A cutter table for performing work operations on one or more layers of sheet-type work material, as defined by claim 6 wherein:

at least one of said first and second upright members, and said cross beam each define a hollow interior area;

at least one electrical conductor is connected at one end to said indicator light and at an opposite end to means for selectively supplying electric power to said indicator light; and wherein said electrical conductor extends through said hollow interior area of said upright member and said cross beam between said light and said means for supplying electrical power.

8. A cutter table for performing work operations on one or more layers of sheet-type work material, as defined by claim 1, wherein said indicating means includes a plurality of lights mounted on said cross beam, each of said lights being a different color.

9. A cutter table for performing work operations on one or more layers of sheet-type work material, as defined by claim 1, wherein said upstanding support includes two elbows, one of which is coupled to said first upright member and an end of said cross beam, and the other of which is coupled to said second upright member and an opposite end of said cross beam.

10. A cutter table for performing work operations on one or more layers of sheet-type work material as defined by claim 1, further comprising;

a bracket coupled to said support, said bracket being adapted to carry said programmable controller.

11. A cutter table for performing work operations on one or more layers of sheet-type work material, comprising:

a frame;

a work material support surface coupled to said frame;

a programmable controller mounted to the cutting table for storing sheet-type work material cutting data, and for issuing commands to said cutter table;

an elongated support mounted on and extending transversely across said frame for movement in a direction longitudinal of said frame in response to commands issued from said programmable controller;

a cutting head coupled to said support for movement in a direction longitudinally thereof, and transversely across said frame in response to commands issued from said programmable controller;

a blade reciprocatingly mounted to said cutting head for performing cutting operations on one or more layers of sheet type work material carried by said support surface;

indicating means for alerting an operator as to the operational status of the cutter table, the indicating means including:

an upstanding support coupled to the frame;

at least one indicating light mounted on the upstanding support; and means for generating a signal to selectively energize the indicating light; and at least one roll of polymeric film defining a longitudinal axis for overlaying and sealing the work material during a cutting operation, the roll of polymeric film being coupled to the upstanding support for rotation about the longitudinal axis, and movement between a raised and a lowered position.

12. A cutter table for performing work operations on one or more layers of sheet-type work material as defined by claim 11, wherein:

said upstanding support includes a pair of upright support members spaced apart from one another on opposing sides of said frame, each upright support defining a hollow interior area and an elongated slot extending from said hollow interior area through a wall of said upright support, longitudinally thereof;

an actuator positioned in said hollow interior area adjacent to said slot; and said roll of polymeric film defining opposed ends, one of which extends through each of said slots and is rotatably coupled to said actuator for movement between said raised and lowered positions in response to commands issued from said controller.

13. A cutter table for performing work operations on one or more layers of sheet-type work material as defined by claim 12, wherein said actuator is a pneumatic cylinder.

14. A cutter table for performing work operations on one or more layers of sheet-type work material as defined by claim 13, wherein said actuator includes a lead screw.

* * * * *